US008191536B2

(12) United States Patent
Devries et al.

(10) Patent No.: US 8,191,536 B2
(45) Date of Patent: Jun. 5, 2012

(54) MULTI-PATH EVAPORATIVE PURGE SYSTEM FOR FUEL COMBUSTING ENGINE

(75) Inventors: Jason Eugene Devries, Belleville, MI (US); Mark William Peters, Wolverine Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1341 days.

(21) Appl. No.: 11/773,780

(22) Filed: Jul. 5, 2007

(65) Prior Publication Data

US 2009/0007890 A1 Jan. 8, 2009

(51) Int. Cl.
*F02M 33/02* (2006.01)

(52) U.S. Cl. ..... 123/520; 123/518; 123/519; 123/481; 123/198 F; 701/112

(58) Field of Classification Search ..... 123/518, 123/519, 520, 521, 527, 548, 516; 73/114.38, 73/114.39; 701/101, 103, 104
See application file for complete search history.

(56) References Cited

U.S. PATENT DOCUMENTS

| | | | | | |
|---|---|---|---|---|---|
| 3,352,294 | A | * | 11/1967 | Skarstrom et al. | 123/519 |
| 3,515,107 | A | * | 6/1970 | Joyce | 123/520 |
| 3,575,152 | A | * | 4/1971 | Wentworth | 123/520 |
| 5,056,494 | A | * | 10/1991 | Kayanuma | 123/519 |
| 5,111,795 | A | * | 5/1992 | Thompson | 123/519 |
| 5,148,793 | A | | 9/1992 | Reddy | |
| 5,165,379 | A | * | 11/1992 | Thompson | 123/520 |
| 5,456,237 | A | * | 10/1995 | Yamazaki et al. | 123/520 |
| 5,477,836 | A | * | 12/1995 | Hyodo et al. | 123/519 |
| 5,479,904 | A | * | 1/1996 | Fujimori et al. | 123/520 |
| 6,374,811 | B1 | * | 4/2002 | Mancini | 123/519 |
| 6,474,148 | B2 | * | 11/2002 | Takagi et al. | 73/114.39 |
| 6,526,950 | B2 | * | 3/2003 | Ito et al. | 123/518 |
| 6,540,815 | B1 | | 4/2003 | Hiltzik et al. | |
| 6,557,534 | B2 | | 5/2003 | Robichaux et al. | |
| 6,679,214 | B2 | | 1/2004 | Kobayashi et al. | |
| 2004/0173190 | A1 | | 9/2004 | Makino | |

FOREIGN PATENT DOCUMENTS

JP 11013559 A * 1/1999

* cited by examiner

*Primary Examiner* — Stephen K Cronin
*Assistant Examiner* — Raza Najmuddin
(74) *Attorney, Agent, or Firm* — Allan J. Lippa; Alleman Hall McCoy Russell & Tuttle LLP

(57) ABSTRACT

A method of operating the evaporative purge system for an engine of a vehicle propulsion system is provided. In one example, the method provides for charging and purging two fuel vapor canisters independently or at the same time. The method may provide for improved fuel vapor processing under some conditions.

13 Claims, 6 Drawing Sheets

MULTI-PATH EVAPORATIVE PURGE SYSTEM FOR FUEL COMBUSTING ENGINE

BACKGROUND AND SUMMARY

Some hybrid vehicle propulsion systems are limited by the available manifold vacuum levels or the duration of time that the engine may be deactivated during operation of the vehicle, such as with some hybrid electric vehicles. Since the evaporative canister is typically purged while the engine is performing combustion in order to utilize the stored fuel vapor for combustion, the amount of time the engine can be turned off may be limited in part by the mass of fuel vapor to be purged from the canister. As one example, the fuel vapor storage canister may be cleaned by purging the canister at least once each drive cycle or once per each fuel tank refueling so that fuel vapor break through does not occur. Furthermore, some evaporative purging systems may also experience difficulty purging fuel vapor from the canister due to excessive vacuum in the fuel tank, thereby limiting the extent to which the purge valve can be opened. For example, the restriction caused by a relatively large evaporative emissions canister configured to store both refueling vapors and diurnal vapors or other system losses may cause a relatively large pressure drop, thereby creating a vacuum on the fuel tank.

As one approach, the inventors have provided herein a method of operating an evaporative purge system for an engine of a vehicle propulsion system, comprising during a first condition, loading at least a first fuel vapor storage canister with fuel vapors (e.g. during a refueling event); during a second condition, purging fuel vapors stored by at least the first canister to the engine; during a third condition, loading a second fuel vapor storage canister with fuel vapors without loading the first canister with fuel vapors; and during a fourth condition, purging fuel vapors stored by the second canister to the engine without purging fuel vapors from the first canister. By independently loading and unloading the canisters in response to operating conditions, engine off time may be increased, at least under some conditions, thereby improving fuel efficiency of the engine.

As a first embodiment, an evaporative purge system for an engine of a vehicle is provided. The system comprises a fuel tank configured to store a fuel; a first canister configured to store a vapor state of the fuel; a second canister configured to store the vapor state of the fuel; a first vapor passage coupling the fuel tank to the first canister; a first valve arranged along the first vapor passage configured to control the flow of vapor through the first vapor passage; a second vapor passage coupling the second canister to the first vapor passage between the first valve and the fuel tank; a third vapor passage coupling the first canister to an intake air passage of the engine; a second valve arranged along the third vapor passage configured to control the flow of vapor through the third vapor passage; a fourth vapor passage coupling the second canister to the third vapor passage between the second valve and the intake air passage; a fifth passage having a first end coupled to the first canister and a second end communicating with ambient; a third valve arranged along the fifth passage configured to control flow through the fifth passage; a sixth passage having a first end coupled to the second canister and a second end communicating with the fifth passage between the third valve and the first canister; and a fourth valve arranged along the third passage between where the fourth passage is coupled to the third passage and the engine, wherein the fourth valve is configured to control flow through the third passage. In this way, vapors may be supplied to or purged from each canister via separate flow paths, thereby providing independent control of the loading and unloading of the canisters.

As a second embodiment, an evaporative purge system for an engine of a vehicle is provided. The system comprises a fuel tank configured to store a fuel; a first canister configured to store a vapor state of the fuel; a second canister configured to store the vapor state of the fuel; a first vapor passage coupling the fuel tank to the first canister; a first valve arranged along the first vapor passage configured to control the flow of vapor through the first vapor passage; a second vapor passage coupling the first canister to the second canister; a second valve arranged along the second passage configured to control the flow of vapor through the second vapor passage, wherein the second valve is a three-way valve; a third vapor passage coupling the first passage to the second passage, wherein the third passage is coupled to the second passage via the three-way valve; a fourth passage having a first end coupled to the second canister and a second end communicating with ambient; a third valve arranged along the fourth passage configured to control flow through the fourth passage; a fifth vapor passage having a first end coupled to the first canister and a second end coupled to an intake passage of the engine; a fourth valve arranged along the fifth vapor passage configured to control the flow of vapor through the fifth vapor passage; and a sixth vapor passage having a first end coupled to the second canister and a second end coupled to the fifth vapor passage between the first canister and the fourth valve. In this way, vapors may be supplied to or purged from each canister via separate flow paths, thereby providing independent control of the loading and unloading of at least the second canister.

DETAILED DESCRIPTION

Figure 1:
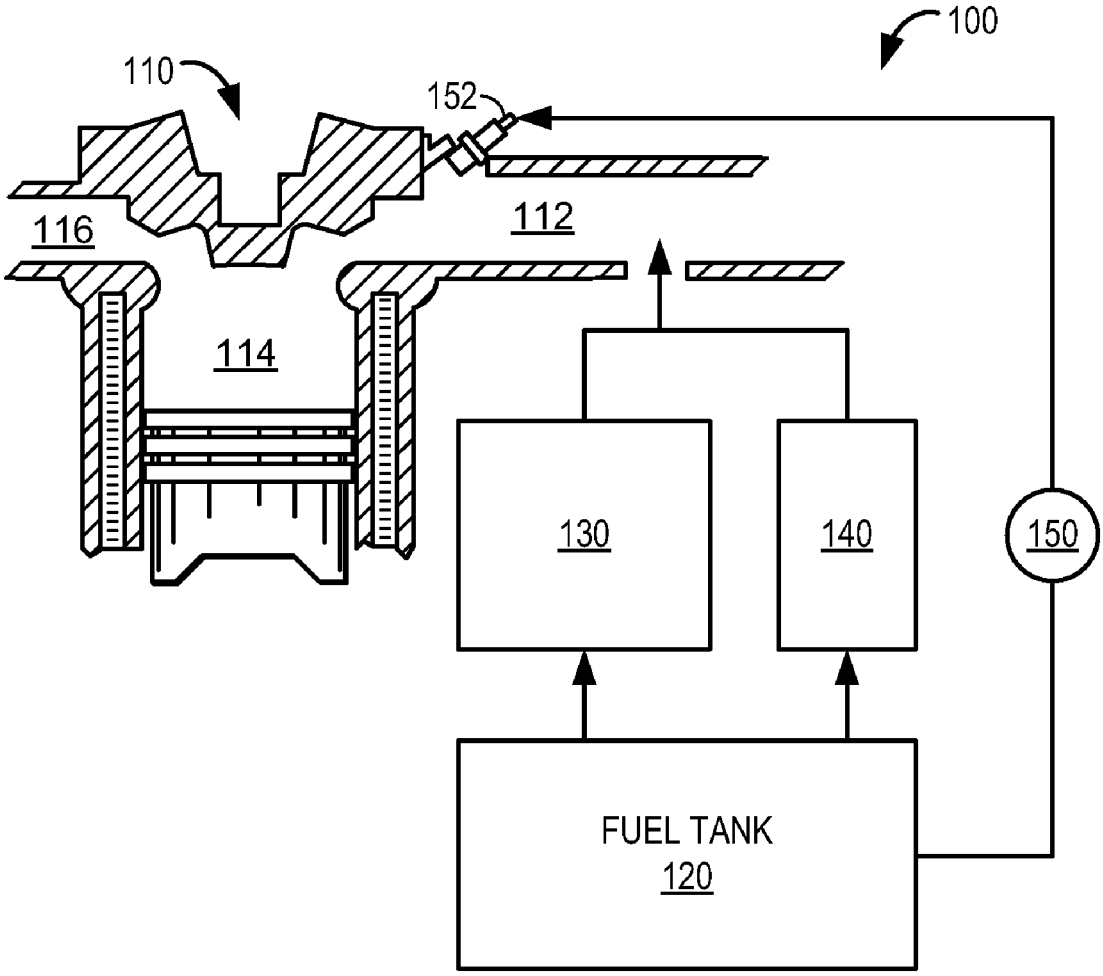
FIG. 1 shows a schematic depiction of an example evaporative purge system.

FIG. 1 shows a schematic depiction of an example evaporative purge system 100. Evaporative purge system 100 may include an internal combustion engine 110, a fuel storage tank 120, a first fuel vapor storage canister 130, and a second fuel vapor storage canister 140. Fuel vapors produced by a liquid fuel within the fuel tank may be stored at one of the first and the second fuel vapor storage canisters based on operating conditions. For example, canister 130 may be loaded with fuel vapors generated during a refueling operation, while canister 140 may be loaded with fuel vapors generated during diurnal or normal usage conditions. As described herein, diurnal conditions may refer to conditions where the fuel tank is not being refueled and may include conditions such as cyclical day time heating that may increase the evaporation rate of fuel stored in the fuel tank. In some embodiments, first canister 130 for storing refueling vapors may include a larger fuel vapor storage capacity than second canister 140 for storing diurnal vapors. Furthermore, as described herein, canister 130 may be purged at a different frequency than canister 140, under some conditions.

Fuel vapors stored at canisters 130 and 140 may be periodically purged to engine 110. For example, as shown in FIG. 1, fuel vapors may be purged from canisters 130 and/or 140 to an intake passage 112 of engine 110, where they may be combusted within at least one combustion chamber 114 of the engine. Additionally, fuel may be supplied to combustion chamber 114 from fuel tank 120 via fuel pump 150 by fuel injector 152, thereby bypassing canisters 130 and 140. The fuel provided to engine 110 from one or more of the first canister 130, second canister 140, and fuel injector 152 may be combusted in combustion chamber 114 before being exhausted from the engine via an exhaust passage 116.

As will described in greater detail herein with reference to FIGS. 2-5, evaporative purging systems having configuration that may be referred to as non-integrated systems will be provided. Non-integrated evaporative purging systems may include systems in which one of the canisters (e.g. canister 130) collects only refueling vapors, while the other canister (e.g. canister 140) collects at least vapors produced during diurnal conditions. Note that canister 140 can also receive refueling vapors in addition to canister 130, in some examples. The non-integrated evaporative purging system can provide an advantage during operation since canister 130, which is configured to receive refueling vapors, is not necessarily required to be loaded with fuel vapors while storing fuel vapors at canister 140, which is instead configured to receive at least diurnal vapors.

In each of the embodiments described herein, canister 130 can be isolated from canister 140 by operating one or more valves, for example, in response to whether the fuel tank is being refueled. Thus, these valves can be actuated in response to a fuel door sensor or refueling trigger during a refueling operation in order to switch the system over to a state that enables canister 130 to receive and store the refueling vapors, while during other conditions the valves can be actuated to enable canister 140 to receive and store at least vapors produced during diurnal conditions.

The first embodiment, which is described with reference to FIGS. 2 and 3, includes a second canister vent valve. With two canister vent valves in the system the control system can control which path the vapors will flow (i.e. through canister 130 or canister 140). These two canister vent valves can then also be used to select which canister fuel vapors will be purged. During an emissions cycle canister 140 can be substantially purged of fuel vapors before purging canister 130.

The second embodiment, which is described with reference to FIGS. 4 and 5, includes a three-way valve arranged between canister 130 and canister 140, thus allowing the flow to be directed through only canister 140 or through both canisters 130 and 140. In a similar fashion, this three-way valve can then also be actuated to partition the purge flow in order to substantially purge canister 140 of fuel vapors before purging canister 130.

Figure 2:
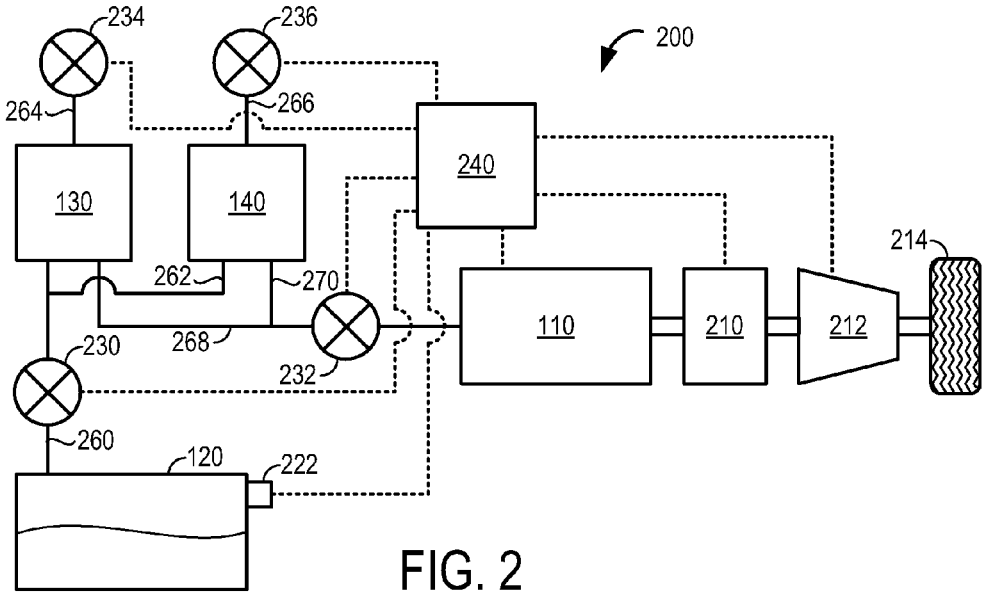
FIG. 2 shows a first embodiment of an evaporative purge system for a vehicle propulsion system.

FIG. 2 shows a first embodiment of an evaporative purge system for a vehicle propulsion system 200. In this particular embodiment, propulsion system 200 is configured as a hybrid electric vehicle (HEV) including engine 110 and electric motor 210. One or more of engine 110 and electric motor 210 may be operatively coupled to at least one vehicle drive wheel 214 via a transmission 212. For example, where propulsion system 200 is configured as a series HEV, engine 110 may be operated to recharge an energy storage device such as an electric battery (not shown), whereby motor 210 utilizes energy stored at the energy storage device to provide the requested propulsive effort at drive wheel 214. As another example, where propulsion system 200 is configured as a parallel HEV, engine 110 and/or motor 210 may be operated to provide the requested propulsive effort at drive wheel 214. In some examples, motor 210 may be omitted.

Regardless of the particular configuration, under select operating conditions, engine 110 may be periodically deactivated, whereby combustion of fuel by the engine is temporarily discontinued. For example, engine 110 may be deactivated by the user upon vehicle shut-off. As another example, engine 110 may be deactivated to provide improved fuel efficiency responsive to operating conditions such as the level of propulsive effort requested by the user and the level of energy stored by the energy storage device, among other conditions. For example, the engine may be deactivated during conditions where motor 210 can provide the requested propulsive effort. As another example, engine 110 can be deactivated where the vehicle is at rest, such as when the vehicle is at a stopped or idle state. In this way, engine 110 may be operated to conserve fuel.

However, during engine deactivation, fuel vapors may accumulate in fuel tank 120. Thus, in the first embodiment shown in FIG. 2, canister 130 can receive fuel vapors from fuel tank 120 via fuel vapor passage 260 and canister 140 can receive fuel vapors from fuel tank 120 via fuel vapor passage 262 coupled to vapor passage 260 between canister 130 and valve 230. Vapor passage 260 can include an intermediate valve 230 for controlling the flow rate of fuel vapors from fuel tank 120 canisters 130 and 140. Canister 130 can selectively communicate with the ambient environment via passage 264 responsive to the position of valve 234. Similarly, canister 140 can selectively communicate with the ambient environment via passage 266 based on the position of valve 236. Canister 130 can purge fuel vapors to engine 110 via fuel vapor passage 268. Canister 140 can purge fuel vapors to engine 110 via fuel vapor passage 270 coupled to passage 268 between canister 130 and valve 232. The flow rate of fuel vapors to engine 110 from canisters 130 and 140 can be controlled via valve 232.

Propulsion system 200 may include a control system 240 for controlling the various vehicle system described herein. For example, control system 240 can be configured to control operation of engine 110, motor 210, and transmission 212 in response to operating conditions. For example, control system 240 can deactivate and reactivate engine 110 and can control the propulsive effort provided by engine 110 and motor 210. Further, control system 240 can be configured to adjust the position of valves 230, 232, 234, and 236 in response to operating conditions. Fuel tank 120 may include a refueling sensor 222 for detecting whether a refueling operation is being performed. For example, refueling sensor 222 can send a control signal to control system 240 to indicate whether a refueling trigger of the fuel tank has been activated. As one non-limiting example, sensor 222 can detect whether a refueling nozzle has been inserted into a refueling door of the fuel tank.

Control system 240 can include an electronic controller configured with a processor, memory, input and output ports. As one example, the electronic controller of control system 240 can include look-up tables or stored valves for enabling the control system to perform the various control strategies and routines described herein. However, in some embodiments, control system 240 may include a mechanically actuated system that utilizes pressure differences between various regions of the evaporative purge system for actuating one or more of valves 230, 232, 234, and/or 236.

Figure 3:
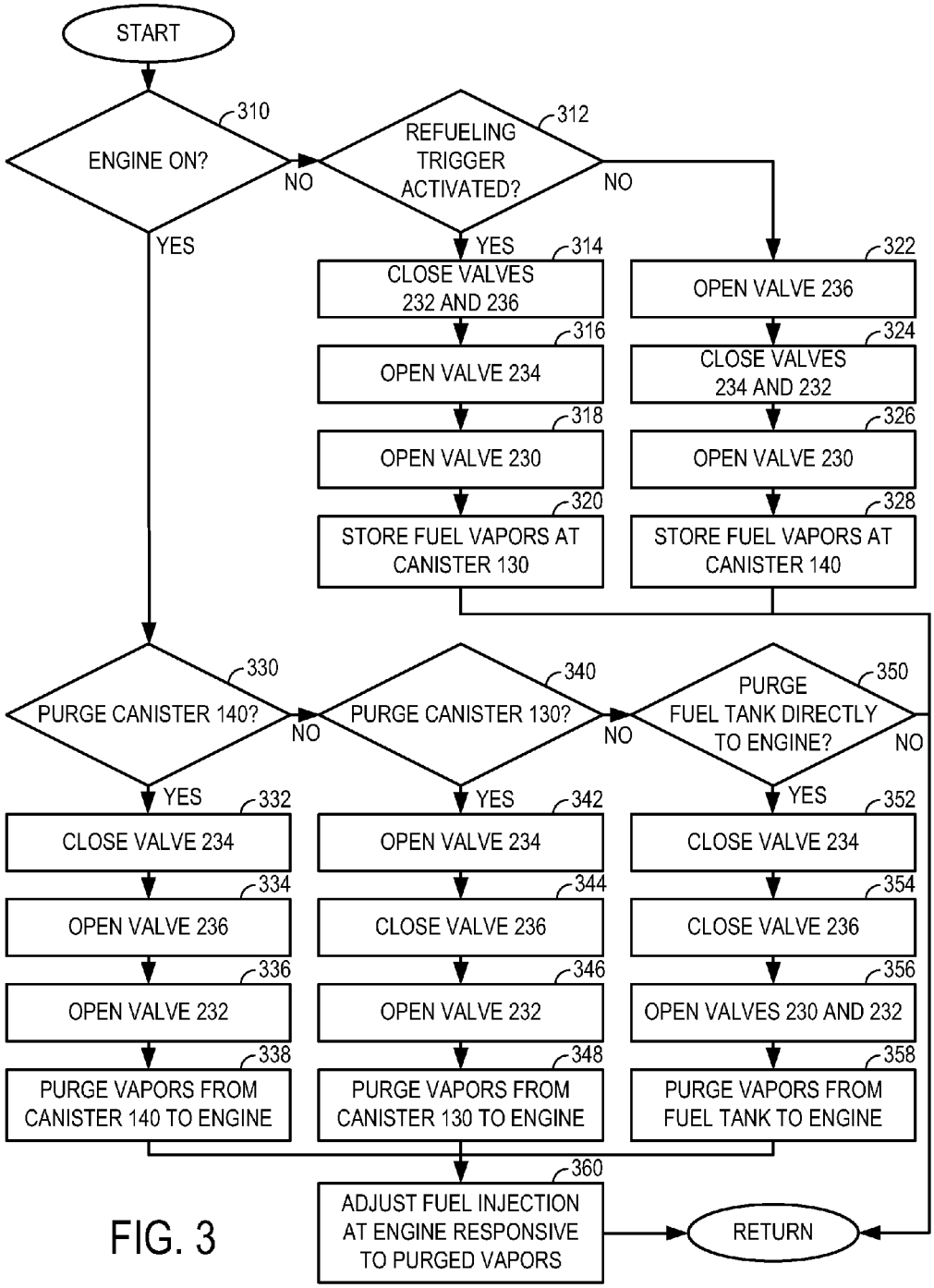
FIG. 3 shows a flow chart depicting an example routine for controlling the first embodiment of the evaporative purge system.

FIG. 3 shows a flow chart depicting an example routine for controlling the first embodiment of the evaporative purge system. At 310, it may be judged whether the engine is on (i.e. is performing combustion of fuel). If the answer at 310 is no (i.e. the engine is deactivated), the routine may proceed to 312. At 312, it may be judged whether the refueling trigger has been actuated, for example, as detected by refueling sensor 222. If the answer at 312 is yes (i.e. the fuel tank is being refueled), the evaporative purge system may be controlled to transport fuel vapors from fuel tank 120 to canister 130 by closing valves 232 and 236 at 314, opening valve 234 at 316, and opening valve 230 at 318, to enable the fuel vapors to be stored at 320 by canister 130. By opening valves 234 and 230, the relatively higher pressure of the fuel tank compared to the ambient environment causes fuel vapors within fuel tank 120 to flow into canister 130 where they may be stored. By closing valve 236, the flow of fuel vapors into canister 140 may be reduced and/or inhibited. Similarly, by closing valve 232, the flow of fuel vapors into engine 110 may be reduced and/or inhibited. In this way, where the fuel tank is being refueled and the engine is deactivated, canister 130 may be loaded with fuel vapors.

Alternatively, if the answer at 312 is no (i.e. the fuel tank is not being refueled), the evaporative purge system may be controlled to transport fuel vapors from fuel tank 120 to canister 140 by opening valve 236 at 322, closing valves 234 and 232 at 324, and opening valve 230 at 326, to enable the fuel vapors to be stored at 328 by canister 130. By opening valves 236 and 230, the relatively higher pressure of the fuel tank compared to the ambient environment causes fuel vapors within fuel tank 120 to flow into canister 140 where they may be stored. By closing valve 234, the flow of fuel vapors into canister 130 may be reduced and/or inhibited. Similarly, by closing valve 232, the flow of fuel vapors into engine 110 may be reduced and/or inhibited. In this way, where refueling of the fuel tank is not being performed and the engine is deactivated, canister 140 can be loaded with fuel vapors. From 320 or 328, the routine may return to 310.

If it is judged at 310 that the engine is on (i.e. performing combustion of fuel), the routine may proceed to 330. At 330 it may be judged whether to purge canister 140. As one example, the control system may purge canister 140 at least once per operating cycle of the engine or the control system may purge canister 140 based on an estimate of the amount of fuel vapors stored by canister 140. As yet another example, the control system may purge canister 140 before deactivating the engine to clear the canister of fuel vapors, thereby increasing the duration of time that the engine may be deactivated. If the answer at 140 is yes (i.e. canister 140 is to be purged), then valve 234 may be closed at 332, valve 236 may be opened at 334, and valve 232 may be opened at 336, whereby fuel vapors may be purged to the engine from canister 140 at 338. For example, the fuel vapors may be purged to intake 114 passage of engine 110. In this way, canister 140 may be purged independently of canister 130. By opening valves 236 and 232, the pressure difference between ambient and the intake manifold of the engine can cause vapors stored at canister 140 flow to the engine, while closing valve 234 can reduce or inhibit the flow of vapors from canister 130.

Alternatively, if the answer at 330 is no, it may be judged at 340 whether to purge canister 130. As one example, canister 130 may be purged at least once per refueling of the fuel tank or may be purged before deactivating the engine. If the answer at 340 is yes, valve 234 may be opened at 342, valve 236 may be closed at 344, and valve 232 may be opened at 346, whereby fuel vapors may be purged to the engine from canister 130 at 348. By opening valves 234 and valves 232 the pressure difference between ambient and the intake manifold of engine 110 can cause vapors stored in canister 130 to flow to the engine, while closing valve 236 inhibits or reduces the flow of vapors from canister 140.

Alternatively, if the answer at 340 is no, it may be judged at 350 whether to purge the fuel tank directly to the engine via one or more of canisters 130 and 140. If the answer at 350 is yes, valve 234 may be closed at 352, valve 236 may be closed at 354, and valves 230 and 232 may be opened at 356 to enable fuel vapors to be purged to the engine from the fuel tank at 358. If the answers at 330, 340, and 350 are no, the routine may return to 310.

From 338, 348, or 358, the routine may adjust the fuel provided to engine 110, for example, via fuel injection, responsive to the purged vapors. As one example, an exhaust gas sensor (e.g. an air/fuel sensor) arranged in the exhaust passage of the engine may be used to provide feedback to control system 240 to enable adjustment of the fuel provided via fuel pump 150 responsive to the quantity of fuel vapors purged to engine 110. Finally, the routine may return to 310.

Figure 4:
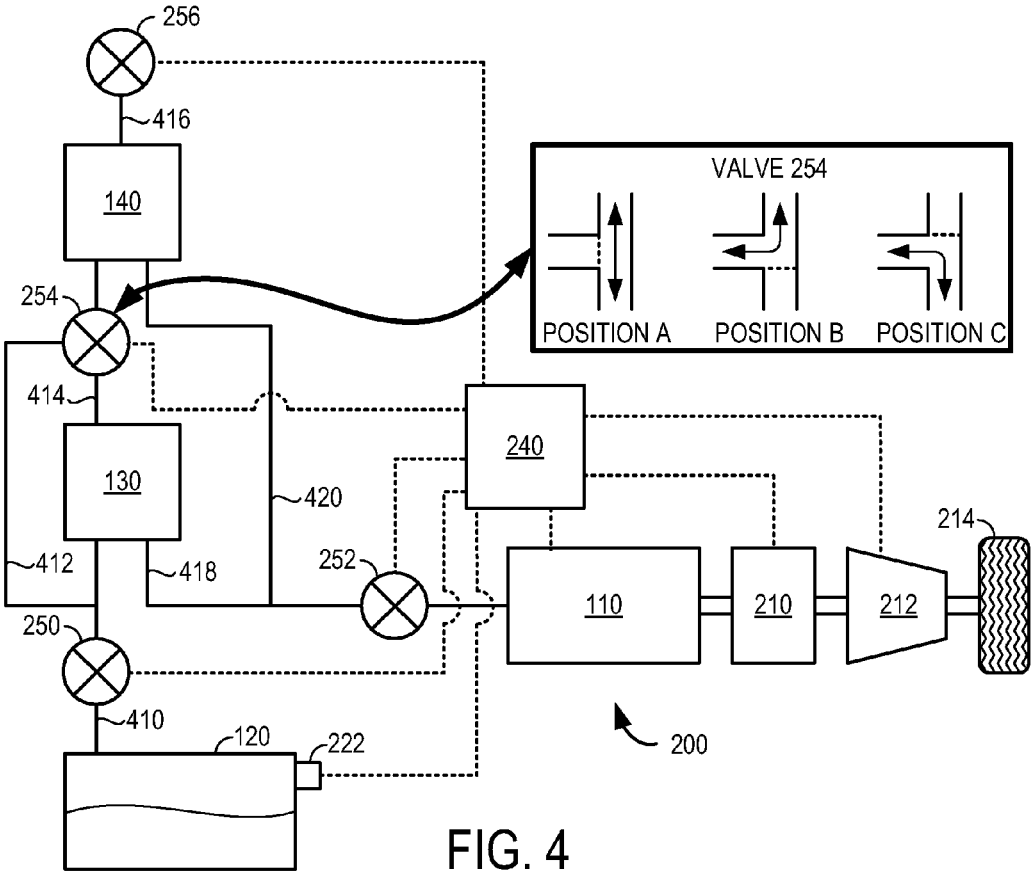
FIG. 4 shows a second embodiment of an evaporative purge system for a vehicle propulsion system.

FIG. 4 shows a second embodiment of an evaporative purge system for a vehicle propulsion system. The second embodiment shown in FIG. 4 includes some of the same components described with reference to the first embodiment shown in FIG. 2, except the valves and vapor passages have a different configuration, and the second embodiment includes a three-way valve. For example, as shown in FIG. 4, canister 130 can selectively communicate with fuel tank 120 via vapor passage 410 based on the position of valve 250. Canister 130 can selectively communicate with canister 140 via vapor passage 414 based on the position of three-way valve 254. Further, passage 410 can selectively communicate with passage 414 via vapor passage 412 based on the position of three-way valve 254, thereby enabling the fuel vapor to bypass canister 130 via passage 412 on its way to flowing into canister 140. Three-way valve 254 is shown in greater detail in FIG. 4 for three different positions.

For example, Position A shows how three-way valve 254 may be adjusted to enable flow between canisters 140 and 130, while inhibiting flow between passage 412 and passage 414. In contrast, Position B shows how three-way valve 254 may be adjusted to enable flow between canister 140 and passage 412, while inhibiting flow between canisters 130 and 140 via passage 414. Further still, Position C shows how three-way valve 254 may be adjusted to enable flow between passages 412 and 414, while inhibiting flow between canisters 140 and 130 via passage 414. In some embodiments, three-way valve 254 may include only Positions A and B, and Position C may be omitted.

Canister 140 can selectively communicate with the ambient environment via passage 416 responsive to the position of valve 256. Further, canisters 140 and 130 can selectively communicate with the engine via passages 418 and/or 420 responsive to the position of valve 252. As shown in FIG. 4, control system 240 can control the position of valves 250, 252, 254, and 256.

Figure 5:
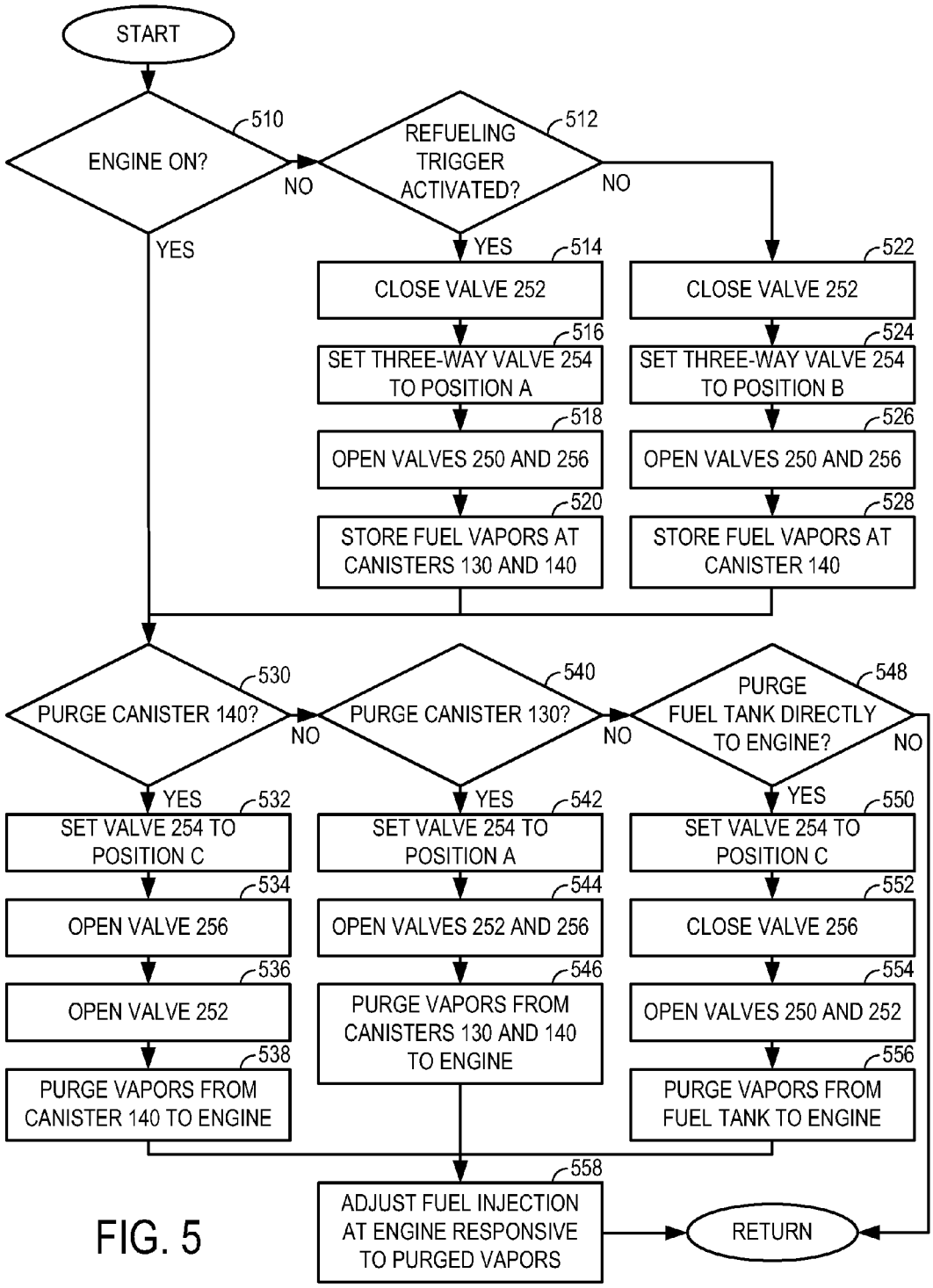
FIG. 5 shows a flow chart depicting an example routine for controlling the second embodiment of the evaporative purge system.

FIG. 5 shows a flow chart depicting an example routine for controlling the second embodiment of the evaporative purge system. At 510 it may be judged whether the engine is on, for example, as described with reference to 310. If the answer at 510 is no, it may be judged at 512 whether the refueling trigger is activated, for example, as described with reference to 312. If the answer at 512 is yes, valve 252 may be closed at 514, the three-way valve may be set to Position A at 516, and valves 250 and 256 may be opened at 518 to enable fuel vapors to be stored by canisters 130 and 140 at 520. By opening valves 250 and 256, the pressure difference between ambient and the fuel tank can cause vapors to flow into canister 130 and/or canister 140.

Alternatively, if the answer at 512 is no, valve 252 may be closed at 522, three-way valve 254 may be set to Position B at 524, and valves 250 and 256 may be opened at 526 to enable fuel vapors to be stored by canister 140 at 528. By opening valves 250 and 256, while setting three-way valve to position B, the pressure difference between ambient and the fuel can cause vapors to flow to canister 140 from the fuel tank and canister 130 may be bypassed via passage 412. From 520 or 528, the routine may return to 510.

Alternatively, if the answer at 510 is yes, it may be judged at 530 whether to purge canister 140. If the answer at 530 is yes, three-way valve 254 may be set to Position C at 532, valve 256 may be opened at 534, and valve 252 may be opened at 536 to enable fuel vapors stored at canister 140 to be purged to the engine at 538. By opening valves 256 and 252, the pressure difference between ambient and the intake manifold of the engine can cause vapors stored at canister 140 flow to the engine, while setting the three-way valve to Position C or alternatively Position B can reduce or inhibit the flow of vapors from canister 130. In this way, canister 140 may be purged independently of canister 130. The control system can utilize the ability to independently purge canister 140, which may be used to store at least diurnal vapors. In some embodiments, canister 140 may be purged before subsequently purging canister 130, which may be used to store only refueling vapors.

Alternatively, if the answer at 530 is no, it may be judged at 540 whether to purge canister 130. If the answer at 540 is yes, three-way valve 254 may be set to Position A at 542, and valves 252 and 256 may be opened at 544 to enable fuel vapors stored in canisters 130 and any remaining vapors stored at canister 140 to be purged to the engine. By opening valves 254 and 256, while setting the three-way valve to Position A, the pressure difference between ambient and the intake manifold of the engine can cause vapors to flow from canisters 130 and 140 to the engine.

Alternatively, if the answer at 540 is no, it may be judged at 548 whether to purge the fuel tank directly to the engine. If the answer at 548 is yes, three-way valve 254 may be set to Position C at 550, valve 256 may be closed at 552, and valves 250 and 252 may be opened at 554 to enable fuel vapors to be purged to the engine from the fuel tank at 556. From 538, 546, or 556 the fuel injection at the engine may be adjusted in response to the purged vapors, for example, based on feedback from an exhaust gas sensor. Finally, the routine may return to 510.

Figure 6:
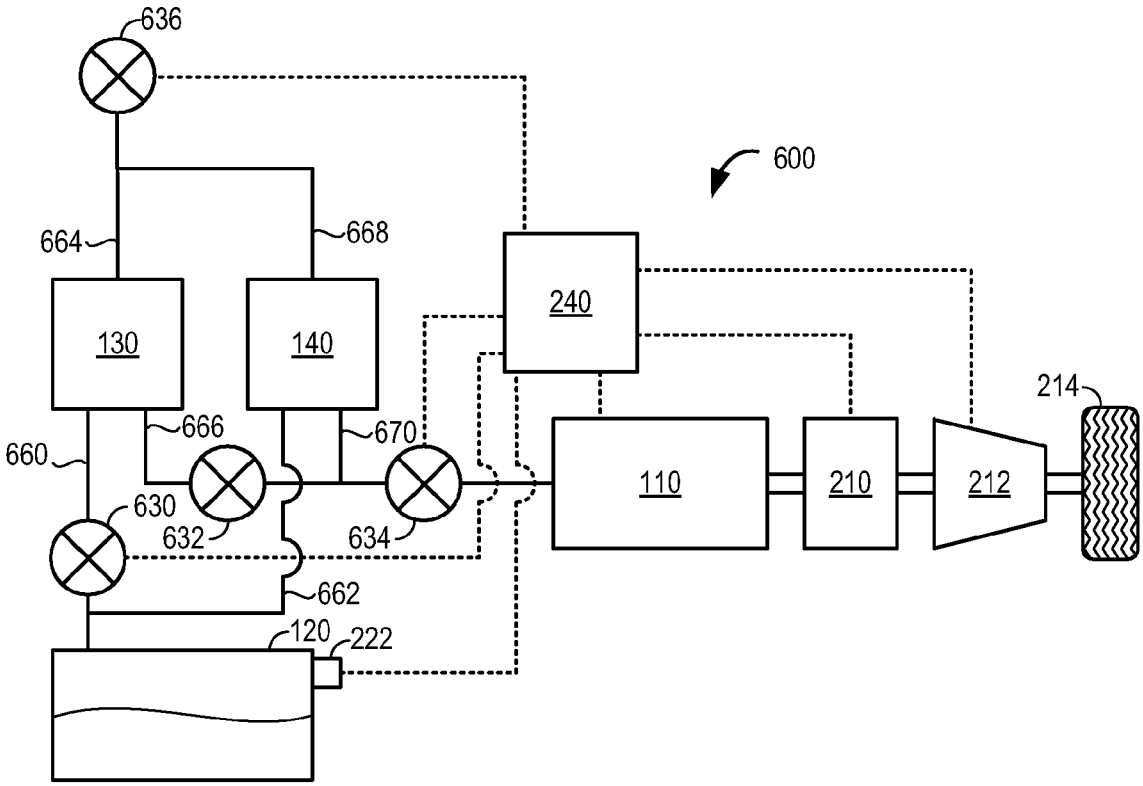
FIG. 6 shows a third embodiment of an evaporative purge system for a vehicle propulsion system.

FIG. 6 shows a third embodiment of an evaporative purge system 600 for a vehicle propulsion system. The third embodiment shown in FIG. 6 includes some of the same components described with reference to the first and second embodiments shown in FIGS. 2 and 4, except that canisters 130 and 140 communicate with ambient via a common valve 636. Further, canister 130 can selectively communicate with fuel tank 120 via vapor passage 660 based on the position of valve 630. Canister 140 communicates with fuel tank 120 via vapor passage 662. Canister 130 can selectively communicate with engine 110 via vapor passage 666 based on the position of valve 632 and 634. Canister 140 can selectively communicate with engine 110 via vapor purge passages 670 and 666 based on the position of valve 634. In this particular example, vapor passage 670 joins with vapor passage 666 between valves 632 and 634. However, in other embodiments, canisters 130 and 140 can communicate with engine 110 via separate independent passage.

Figure 7:
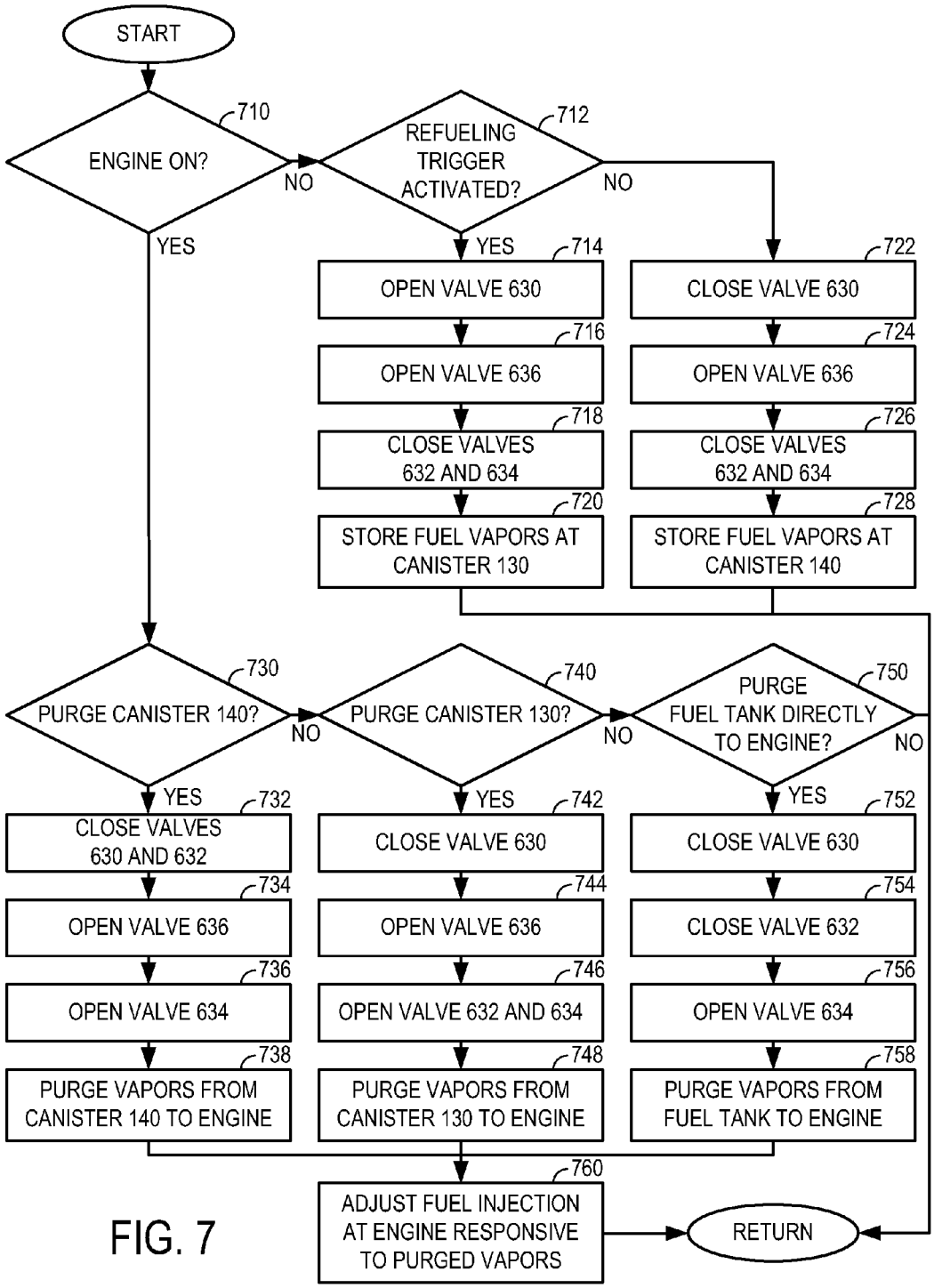
FIG. 7 shows a flow chart depicting an example routine for controlling the third embodiment of the evaporative purge system.

FIG. 7 shows a flow chart depicting an example routine for controlling the third embodiment of the evaporative purge system. Note that some or all of the valves may be operated by control system 240 as directed by the routine shown in FIG. 7, while some of the valves may be actuated without direct actuation by the control system. For example, some of the valves may be operated as directed by the routine of FIG. 7 based on pressure differences across the valve or by actuators directly linked to the valve.

At 710 it may be judged whether the engine is on, for example, as described with reference to 310. If the answer at 710 is no, it may be judged at 712 whether the refueling trigger is activated, for example, as described with reference to 312. If the answer at 712 is yes, valve 630 may be opened at 714, valve 636 may be opened at 716, and valves 632 and 634 may be closed at 718 to enable fuel vapors to be stored by at least canister 130 at 720. It should be appreciated that the configuration of the third embodiment additionally enables at least some fuel vapors to be stored at canister 140. In some examples, passages 660 and/or 664 may be sized relative to passages 662 and 668 so that the majority of fuel vapors are stored at canister 130 during refueling of the fuel tank. Thus, by opening valves 630 and 636, the pressure difference between ambient and the fuel tank can cause vapors to flow into canister 130 and/or canister 140 during a refueling operation of the fuel tank.

Alternatively, if the answer at 712 is no, valve 630 may be closed at 722, valve 636 may be opened at 724, and valves 632 and 634 may be closed at 726 to enable fuel vapors to be stored by canister 140 at 728. By opening valve 636 while closing valve 630, the pressure difference between ambient and the fuel tank can cause vapors to flow to canister 140 via passage 662 from the fuel tank. From 720 or 728, the routine may return to 710.

Alternatively, if the answer at 710 is yes, it may be judged at 730 whether to purge canister 140. If the answer at 730 is yes, valves 630 and 632 may be closed at 732, valve 636 may be opened at 734, and valve 634 may be opened at 736 to permit fuel vapors to flow from canister 140 to an air intake passage of engine 110 via passages 670 and 666 as indicated at 738. In this way, canister 140 may be purged independently of canister 130. The control system can utilize the ability to independently purge canister 140, which may be used to store at least diurnal vapors or vapors produced during operation of the vehicle. In some examples, canister 140 may be purged before subsequently purging canister 130, where canister 130 is operated to store only refueling vapors.

Alternatively, if the answer at 730 is no, it may be judged at 740 whether to purge canister 130. If the answer at 740 is yes, valve 630 may be closed at 742, valve 636 may be opened at 744, and valves 632 and 634 may be opened at 746 to enable fuel vapors stored at canister 130 to flow to an intake passage of engine 110 as indicated at 748. By opening valves 632 and 634, while valve 636 is opened, the pressure difference between ambient and the intake manifold of the engine can cause vapors to flow from canister 130 to the engine as indicated at 748. Further, based on the configuration of the third embodiment, fuel vapors may also be simultaneously purged from canister 140 during purging of canister 130. As one example, where canister 140 is purged before canister 130, a subsequent purge of canister 130 may also enable any fuel vapors remaining in canister 140 to be purged. In alternate embodiments, valve 634 may be arranged along passage 670 to enable independent purging of canister 130 without purging canister 140.

Alternatively, if the answer at 740 is no, it may be judged at 750 whether to purge the fuel tank directly to the engine. If the answer at 750 is yes, valve 630 may be closed at 752, valve 632 may be closed at 754, and valve 634 may be opened at 756 to permit fuel vapors stored at the fuel tank to flow to the engine via canister 140 as indicated at 758. From 738, 748, or 758 the fuel injection at the engine may be adjusted in response to the purged vapors, for example, based on feedback from an exhaust gas sensor. As one example, the amount of fuel injection provided to the engine may be reduced with increasing amount of fuel vapors supplied to the engine to maintain a similar air/fuel ratio before, during, and/or after the purge. Finally, the routine may return to 710.

Thus, in each of the embodiments described herein, the evaporative purge system may be operated to enable at least one canister to be loaded with fuel vapors and purged independent of the other canister. For example, during a refueling condition, a first and/or second fuel vapor storage canister may be loaded with fuel vapors while during a second condition, the fuel vapors stored by the first and/or second canister may be purged to the engine. During a third condition, a second fuel vapor storage canister may be loaded with fuel vapors without loading the first canister with fuel vapors, and during a fourth condition, fuel vapors stored by the second canister may be purged to the engine without purging fuel vapors from the first canister. In this way, engine off time may be increased and at least some limitations caused by other fuel vapor purging system Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A method of operating an evaporative purge system for an engine of a vehicle propulsion system, comprising:

during a first condition, loading at least a first fuel vapor storage canister with fuel vapors from a fuel tank via a first fuel vapor passage and inhibiting fuel vapors from passing through a second fuel vapor storage canister;

during a second condition, purging fuel vapors stored by at least the first fuel vapor storage canister to the engine;

during a third condition, loading the second fuel vapor storage canister with fuel vapors from the fuel tank via the first fuel vapor passage and inhibiting fuel vapors from passing through the first fuel vapor storage canister;

during a fourth condition, purging fuel vapors stored by the second fuel vapor storage canister to the engine without purging fuel vapors stored in the first fuel vapor storage canister; and deactivating the engine during the first and third conditions and operating the engine to combust the purged fuel vapors during the second and fourth conditions, and where the fourth condition occurs before the second condition after an engine start.

2. The method of claim 1, further comprising, during the second condition, purging fuel vapors stored by the second fuel vapor storage canister to the engine.

3. The method of claim 1, wherein during said second condition, the first fuel vapor storage canister is purged without purging fuel vapors from the second fuel vapor storage canister.

4. The method of claim 1, wherein the first condition occurs when the fuel tank coupled to at least the second fuel vapor storage canister is being refueled.

5. The method of claim 4, wherein the third condition occurs when the fuel tank is not being refueled.

6. The method of claim 1, wherein the first fuel vapor storage canister has a greater fuel vapor storage capacity than the second fuel vapor storage canister.

7. The method of claim 1, wherein said fuel vapors are purged to an intake manifold of the engine.

8. An evaporative purge system for an engine of a vehicle, comprising:

a fuel tank configured to store a fuel;

a first canister configured to store a vapor state of the fuel;

a second canister configured to store the vapor state of the fuel;

a first vapor passage coupling the fuel tank to the first canister;

a first valve arranged along the first vapor passage configured to control flow of vapor through the first vapor passage;

a second vapor passage coupling the first canister to the second canister;

a second valve arranged along the second vapor passage configured to control flow of vapor through the second vapor passage, wherein the second valve is a three-way valve;

a third vapor passage coupling the first vapor passage to the second vapor passage, wherein the third vapor passage is coupled to the second vapor passage via the three-way valve;

a fourth vapor passage having a first end coupled to the second canister and a second end communicating with ambient;

a third valve arranged along the fourth vapor passage configured to control flow through the fourth vapor passage;

a fifth vapor passage having a first end coupled to the first canister and a second end coupled to an intake passage of the engine;

a fourth valve arranged along the fifth vapor passage configured to control flow of vapor through the fifth vapor passage; and a sixth vapor passage having a first end coupled to the second canister and a second end coupled to the fifth vapor passage between the first canister and the fourth valve.

9. The system of claim 8, wherein the first canister has a greater fuel vapor storage capacity than the second canister.

10. The system of claim 8, further comprising a control system communicatively coupled to the first, second, third, and fourth valves; wherein the control system is configured to:

during a first condition, load the second canister with fuel vapors without loading the first canister with fuel vapors by operating at least some of said valves;

during a second condition, purge fuel vapors stored by the second canister to the engine without purging fuel vapors from the first canister by operating at least some of said valves;

during a third condition, loading at least the first canister with fuel vapors by operating at least some of said valves; and during a fourth condition, purging fuel vapors stored by at least the first canister to the engine by operating at least some of said valves.

11. The system of claim 10, wherein the engine is coupled with a hybrid propulsion system including at least an electric motor; and wherein the control system is further configured to:

during the first and third conditions, turn the engine off and operate the motor to propel the vehicle; and during the second and fourth conditions, turn the engine on and operate the engine to combust said purged fuel vapors.

12. The method of claim 1, further comprising, during a fifth condition, purging fuel vapors from the fuel tank directly to the engine.

13. The method of claim 1, where during the third condition, fuel vapors bypass the first fuel vapor storage canister via a second fuel vapor passage.

* * * * *